United States Patent [19]

Mrlik

[11] 4,029,445

[45] June 14, 1977

[54] ROTARY COMBUSTION ENGINE APEX SEAL ARRANGEMENT

[75] Inventor: Jerry R. Mrlik, Birmingham, Mich.

[73] Assignee: General Motors Corporation, Detroit, Mich.

[22] Filed: Aug. 11, 1976

[21] Appl. No.: 713,271

Related U.S. Application Data

[63] Continuation of Ser. No. 591,752, June 30, 1975, abandoned.

[52] U.S. Cl. ..... 418/120; 418/122

[51] Int. Cl.[2] ..... F01C 19/04

[58] Field of Search ..... 418/111, 113, 119–124

[56] References Cited

UNITED STATES PATENTS

| | | | |
|---|---|---|---|
| 2,274,232 | 2/1942 | Boyer | 418/111 |
| 3,130,900 | 4/1964 | Schlor | 418/122 |
| 3,253,581 | 5/1966 | Nallinger | 418/113 |

FOREIGN PATENTS OR APPLICATIONS

| | | | |
|---|---|---|---|
| 1,242,938 | 6/1967 | Germany | 418/122 |

*Primary Examiner*—John J. Vrablik

*Attorney, Agent, or Firm*—Ronald L. Phillips

[57] ABSTRACT

A rotary combustion engine apex seal arrangement comprising two end segments forced by a spring biased wedge shaped central segment arranged therebetween to engage a peripheral wall at their outer sealing surfaces and also to engage the respective adjoining side walls at their outer ends thereby leaving a gap only between their inner ends which is substantially filled by the tip of the central segment.

4 Claims, 3 Drawing Figures

ROTARY COMBUSTION ENGINE APEX SEAL ARRANGEMENT

This is a continuation, of application Ser. No. 591,752, filed June 30, 1975, now abandoned.

This invention relates to a rotary combustion engine apex seal arrangement and more particularly to such an arrangement where the seal comprises two end segments engaged by a spring biased wedge shaped central segment.

Rotary combustion engine apex seals of the type comprising a gas pressure biased rigid bar experience high bending stresses in attempting to conform to the peripheral wall on which they slide as the wall changes to an arcuate shape lengthwise of the apex seal because of the gas pressure in the chambers and/or heat expansion. It is also known that these bending stresses can become excessively high where the apex seal passes over a peripheral exhaust port and is then supported only adjacent its two ends. In the continuing development of apex seals, a primary concern has been to further reduce leakage past the apex seal and improve heat transfer from the seal to the housings and substantial improvements have been made with a multi-segment apex seal arrangement as compared with a one-piece apex seal. Typically, the multi-piece apex seal has a long main segment which spans substantially the width of the peripheral wall and engages this wall and one or two small end segments which have ramp engagement with the main segment and engage the side walls. However, the main segment remained rigid with the result that high bending stresses were not avoided or relieved while the leakage was reduced and heat transfer improved. Examples of such multi-segment apex seals are disclosed in U.S. Pat. Nos. 3,556,695, 3,400,691 and 3,712,767. On the other hand, it has been proposed to make the main apex seal segment relatively flexible in bending so as to conform with the changing contour of the peripheral wall as disclosed in U.S,. Pat. No. 3,716,313. However, the change in contour is not uniform completely around the peripheral wall and fatique life of such a seal and its possible protrusion out into a peripheral port becomes a concern. Another approach to maintaining apex seal contact with the changing contour of the peripheral wall has been to provide a pair of juxtaposed apex seals at each rotor apex which are each divided into segments with the gaps between the segments arranged so as not to align as disclosed in U.S. Pat. No. 3,252,581. However, in the latter type of apex seal arrangement leakage gaps remain at the opposite ends of the seals and one or more of the many segments could protrude out into a peripheral intake and/or exhaust port as they pass. There thus remains a need for a very simple yet readily conformable low leakage apex seal arrangement that experiences only low bending stresses and can be used with a peripheral intake and/or exhaust port.

A recently successful solution is to provide two short apex seal segments which are arranged end-to-end and have ramps on their underneath sides contacted directly by a common spring so that they engage the peripheral wall at their outer sealing surfaces and also engage the respective adjoining side walls at their outer ends with the result that there is only a single leakage gap between their inner ends. This arrangement is disclosed in detail in copending U.S. patent application Ser. No. 528,433 filed Nov. 29, 1974 and assigned to the assignee of this invention. In this improved arrangement even further advantages are possible if the two apex seal segments could be better sealed against leakage in the slot they occupy, if the space beneath the seal into which gaseous mixture from the chambers can enter could be substantially reduced to thus reduce undesirable emissions and if the single remaining leakage gap could be reduced substantially under all engine operating conditions.

According to the present invention, these tasks are accomplished with a relatively simple apex seal arrangement comprising two end segments which are arranged end-to-end in a slot in the rotor and are forced against both the peripheral wall and the respective adjoining side walls by a spring loaded central segment of trapezoidal shape arranged therebetween and by gas pressure which pushes radially outward on the bottom side of all the segments. The only possible leakage gap is between the inner ends of the end segments and this is almost completely filled by the top of the central segment above the top of the apex seal slot. The central segment top which also has a sealing surface like the end segments for engaging the peripheral wall has a very short length permitting close end spacing of the end segments and is determined according to the heat expansion of the end segments to have zero or minimum clearance with the peripheral wall when the engine is cold with this clearance then increasing to a predetermined maximum when the engine is hot that is limited to being less than the normal clearance between the peripheral wall and the top of the apex seal slot in the rotor. Furthermore, the end segments have a ramp at their inner end engaged by one of the non-parallel sides of the central segment and the ramp and side angles are made slightly different, i.e. purposely mismatched, so that in addition to providing the desired directional forces on the end segments the cooperating central wedge side and end segment ramp contact occurs at the inner end of the end segment and thus provides sealing therebetween in the slot adjacent the single central leakage gap. Then as the peripheral wall changes with gas pressure and/or heat expansion and the apex seal segments tilt slightly to conform thereto, the contacting central segment sides and end segment ramps come into full engagement for better sealing along their juncture. Furthermore, the trapezoidal shape of the central segment together with that of the end segments effectively serves to occupy a large volume of the apex seal slot thus minimizing the space underneath the seal to which gas mixture from the chambers can enter.

Thus, one of the beneficial features of the apex seal arrangement in the aforementioned U.S. patent application Ser. No. 528,433 is retained in that the apex seal segment inner ends can still be located so that they are supported by a bridge across the exhaust port as disclosed in copending U.S. Ser. No. 519,813 filed Nov. 1, 1974 and assigned to the assignee of this invention. Also, there remains only a single leakage gap at the peripheral wall and this is between the inner ends of the apex seal segments rather than at their outer ends and since the height of this leakage gap is substantially smaller than the clearance between the top of the apex seal slot and the peripheral wall, there is substantially reduced leakage which results is more compression pressure, lower fuel consumption, higher power and lower hydrocarbon emissions. In addition, the central gap provides for a further reduction in hydrocarbons because any leakage therethrough is more likely to be burned gas rather than the unburned gas that can leak past an end as in certain other apex seal arrangements.

An object of the present invention is to provide a new and improved rotary combustion engine apex seal arrangement.

Another object is to provide a new and improved rotary combustion engine apex seal arrangement having good conformability with the peripheral wall it engages as the wall grows concave because of the gas pressure in the chambers and/or heat expansion and also having good internal sealing and with a very small amount of space left beneath the seal.

Another object is to provide in a rotary combustion engine a multi-segment apex seal arrangement comprising end-to-end end segments which are forced by a spring biased central segment to engage a peripheral wall at their outer sealing surfaces and also to engage the adjoining side walls at their respective outer ends and herein the central segment also has a sealing surface for engaging the peripheral wall when the engine is cold which does not rec de with heat expansion as far as the top of the apex seal slot in the rotor.

These and other objects of the present invention will be more apparent from the following description and drawing in which.

Figure 1:
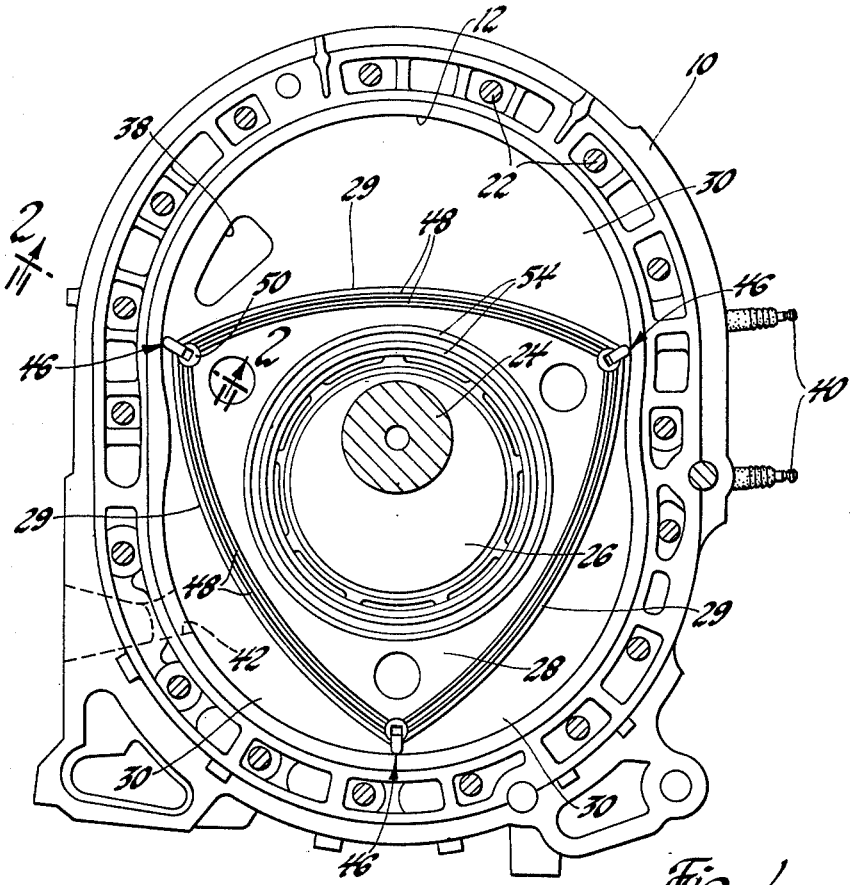
FIG. 1 is an end elevation view with parts removed and parts in section of a rotary combustion engine having an apex seal arrangement according to the present invention.
Figure 2:
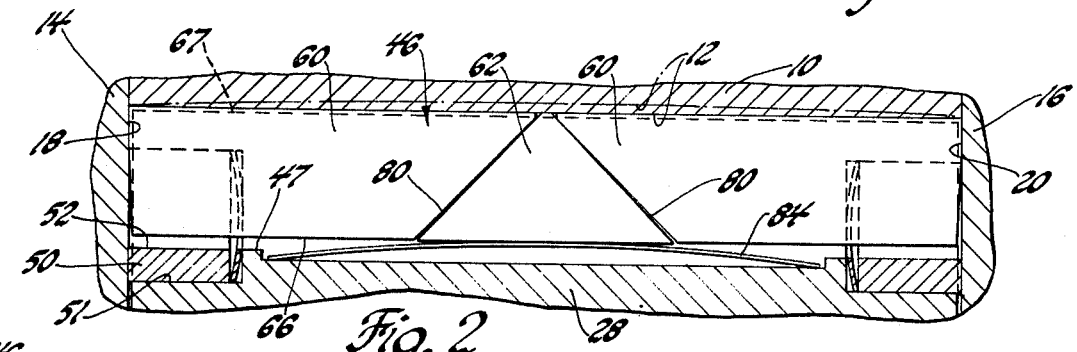
FIG. 2 is an enlarged view taken along the line 2—2 in FIG. 1.

The apex seal arrangement according to the present invention is for use in a rotary internal combustion engine as shown in FIGS. 1 and 2. The engine generally comprises a rotor housing 10 having an inwardly facing inner peripheral wall 12 and a pair of end housings 14 and 16 having parallel, oppositely facing inner side walls 18 and 20 respectively. The housings are secured together by bolts 22 with the inner housing walls 12, 18 and 20 cooperatively providing a cavity. A crankshaft 24 is rotatably supported in the end housings 14 and 16 and has an eccentric 26 on which a rotor 28 is rotatably mounted in the cavity. The inner peripheral wal 12 parallels a two-lobe epitrochoid and the rotor 28 has the general shape of a triangle with faces 29 that cooperate with the inner peripheral wall and also the side walls 18 and 20 to define three variable volume working chambers 30 that are spaced about and move with the rotor as it rotates about the eccentric 26 while the crankshaft 24 turns.

Each of the working chambers 30 is forced to sequentially expand and contact between minimum and maximum volume twice during each rotor revolution is fixed relation to the housing by forcing the rotor 28 to rotate at one-third the speed of the crankshaft 24. This is accomplished by gearing, not shown, comprising an internal tooth gear which is concentric and integral with one side of the rotor 28 and meshes with an external tooth gear which is received with clearance about and is concentric with the crankshaft 24 and is made stationary by being secured to one of the end housings. The rotary gear has one and one-half times the number of teeth as the stationary gear to provide the required speed ratio of 3:1 between the crankshaft and rotor.

A combustible air-fuel mixture from a suitable carburetor and intake manifold arrangement, not shown, is made available to the working chambers 30 by intake passages in the end housings which terminate with oppositely facing intake ports 38 in the side walls 18 and 20 with the intake ports being located so that they open to the working chambers as they expand. Then as the chambers contract the rotor 28 closes the working chambers to the intake ports and the trapped fuel mixture is then compressed and when the rotor faces 29 of the respective chambers are in the vicinity of top-dead-center, the compressed mixture is ignited by a pair of spark plugs 40 which are mounted on the rotor housing 10 with their electrodes exposed through the inner peripheral wall 12 to the passing working chambers. Upon ignition of the mixture in each working chamber the peripheral wall takes the reaction forcing the rotor 28 to continue its forward motion while the gas is expanding. The leading rotor apex of each working chamber eventually traverses an exhaust port 42 in the inner peripheral wall 12 whereby the exhaust products are then exhausted to an exhaust manifold, not shown.

Sealing of the working chambers 30 for such 4-cycle operation is provided by three apex seal arrangements 46 according to the present invention which are each mounting in an axially extending radially outwardly facing slot 47 at the apexes or corners of the rotor and extend the width thereof as described in more detail later. Three pairs of side seals 48 are mounted in axially outwardly facing slots in each rotor side and extend adjacent the rotor faces between two apex seal arrangements 46 and are spring biased outwardly to engage the opposite side wall. In addition, three cylindrical corner seals 50 are mounted in cylindrical holes 51 in each rotor side and spring biased outwardly to engage the opposite side wall with each corner seal having a slot 52 receiving one end of an apex seal and providing sealing between adjacent ends of two pairs of side seals and this apex seal. In addition to the gas seals carried on the rotor 28 there is provided in each rotor side a pair of oil seals 54 that are located radially inwardly of the side seals 48 in axially outwardly facing circular grooves. The oil seals 54 are spring biased outwardly to engage the opposite side wall to prevent the oil supplied for rotor cooling and bearing lubrication from reaching the radially outwardly located gas seals.

Describing now the details of the apex seal arrangement 46 according to the present invention, there are two identical end segments 60 and a central segment 62 of general rectangular cross-sectional shape which are arranged in each apex seal slot 47. Both the end segments 60 and the central segment 62 have trapezoidal shapes of approximately equal height and extend a short distance out of the slot while leaving a small space underneath. The longest side 64 of the end segments 60 is the outer or top side and has a rounded sealing surface and extends parallel to and approximately half the width of the peripheral wall 12 while the opposite or bottom shorter side 66 extends parallel to and faces the bottom of the apex seal slot 47. In addition, each of the end segments 60 has a flat outer end 68 which extends parallel to and faces the respective stationary side wall while the opposite or inner end has a flat 70 that extends radially inwardly from the sealing surface 64 perpendicular to the peripheral wall 12. The flat 70 is short in height having a dimension substantially less than the radial clearance between the peripheral wall 12 and the top 67 of the apex seal slot as can be seen in FIG. 2. Each flat 70 joins at a point substantially above the top 67 of the apex seal slot with a flat angled portion or ramp 72 which constitutes most of this end of the segment and is oblique to both the peripheral wall 12 and the parallel side walls 18 and 20. Thus, the flat 70 gives strength to the edge of the sealing surface 64 at the inner end of the end segments and it will be understood that this flat could be eliminated and in that case the ramp 72 would continue to this sealing surface edge.

The inner ends of the end segments 60 with their oppositely facing inclined flat surfaces 72 at opposite and equal oblique angles leave a trapazoidally shaped space therebetween whose top is short at the peripheral wall 12 and whose bottom is long, spanning for example almost one-third the width of the peripheral wall. The central segment 62 fits in and generally conforms to this space having a rounded sealing surface 76 of short length at its top that extends parallel to and is for engaging the peripheral wall 12 while the opposite or bottom side which is of much longer length extends parallel to and faces the bottom of the apex seal slot 47. The non-parallel sides 80 of the central segment 62 are at opposite and equal oblique angles to the peripheral wall and side walls and form ramps which engage the oppositely facing inclined portions 72 of the end segments, there being a slight difference in the angles of the inclined sides of the central segment 62 and the inclined inner end portion 72 of the end segments for reasons which will become more apparent later in the description.

The generally contiguous bottoms 66 and 78 of the segments leave only a small space underneath the apex seal arrangement and this space is slightly enlarged in the center by a recess 82 formed in the bottom of the slot which receives a leaf spring 84. The spring 84 seats at its opposite ends in the corners of the recess 82 and engages the base 78 of the central wedge 62 at its center whereby the central segment 62 is normally urged radially outward whiile the spring is trapped in position in the recess. During engine cranking the spring 84 thus applies a radially outwardly acting force on the wedge 62 but during engine operation gas passes from the chambers through the clearance between one side of the apex seal arrangement and the oppositely facing side of the apex seal slot. This gas pressure in the bottom of the apex seal slot 47 pushes radially outwardly on the bottom of the central segment 62 and also on the bottom 66 of the end segment 60. The central segment 62 which is thus biased outwardly by a spring force during engine cranking and by gas pressure from the chambers during engine operation urges or wedges the end segments 60 radially and axially outward to thus cause their round outer sealing surface 64 and flat end sealing surface 68 to engage the peripheral wall 12 and respective adjoining side walls 18 and 20, the angle of the engaged inclined surfaces 72 and 80 being selected to provide a higher radial force component. Thus, the end segments 60 are urged apart leaving a gap 86 between the inner ends.

The central segment 62 is determined according to the heat expansion of all the seal parts, but mainly the end segments, so that when the engine is cold its rounded sealing surface 76 actually contacts or comes very close to the peripheral wall 12 and the top or tip of the central segment substantially fills the gap 86 to limit leakage therethrough during engine cranking when it is very desirable to provide highly effective sealing for starting at the lowest possible cranking speeds. Then, as the engine warms and the end segments expand thereby growing axially inward, the width of the gap 86 will necessarily and desirably close down forcing the central segment 62 radially inward. With this heat expansion the central segment's top with the sealing surface 76 is not permitted to recede radially inwardly as far as the top 67 of the apex seal slot as shown by the phantom-line central segment position in FIG. 3. As a result, very tight sealing is provided when the engine is cold for starting at low cranking speeds but then when the engine is warmed up any radial growth in central leakage gap 86 between the oppositely facing inner ends of the end segments is minimized by preventing it from ever growing to a height equal to the existing or normal radial clearance between the peripheral wall 12 and the top 67 of the apex seal slot. This would not be the case if the central segment top with the sealing surface 76 was permitted to recede into the apex seal slot. In other words, the central leakage gap 86 is reduced by the occupation of the tip of the central segment above the seal slot top 76 and has a controlled height and thus area determined by the clearance between the peripheral wall 12 and the central segment sealing surface 76 which is made substantially smaller than known apex seal arrangements whose leakage gap height is the full radial distance between the peripheral wall and the top of the apex seal slot. Since the only leakage gap is thus substantially reduced there is not only more compression pressure but there is lower fuel consumption, higher power and lower HC emissions as compared with other known apex seal arrangements having a central leakage gap. Furthermore, since the leakage gap is located at the center rather than at the end, there is provided a further reduction in HCs since any leakage therethrough is more likely to be burned gas rather than unburned gas out at the outer ends.

Figure 3:
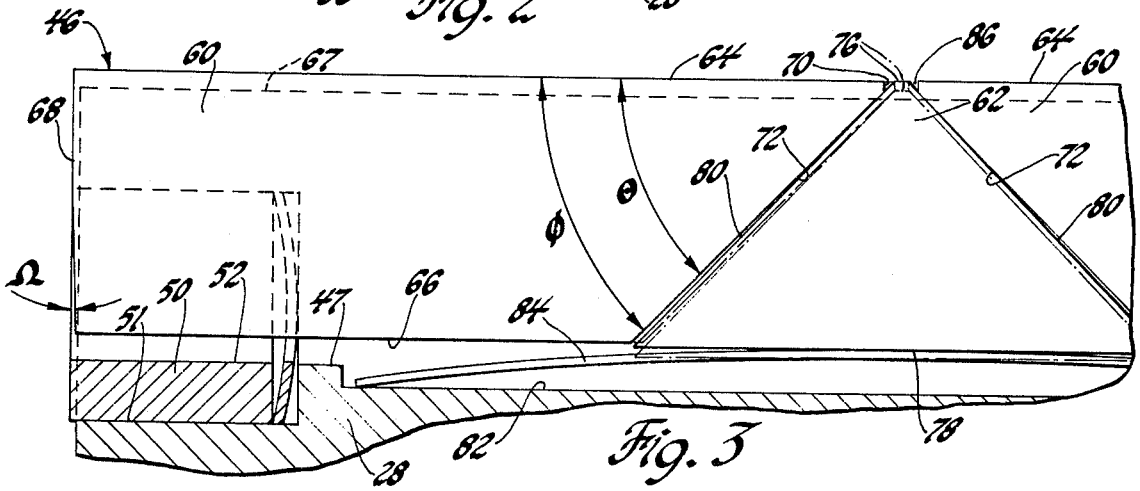
FIG. 3 is an enlarged view of a portion of the seal from FIG. 2.

As best shown in FIG. 3, the angle $\theta$ of the angled sides 80 of the central segment 62 is made slightly steeper than the angle $\phi$ of the end segment ramps 72 so that rather than having matched ramp angles which then could be randomly mismatched at engine assembly because of manufacturing tolerances and assembly line practices, there is purposely provided a predetermined mismatching within manufacturing tolerances that causes the central segment sides 80 to contact the end segment angled sides 72 adjacent the opposite sides of the leakage gap 86. As a result, sealing is provided between the end segments 60 and central segment 62 close to where any leakage will occur rather than letting manufacturing tolerances permit their contact to be made at the opposite ramp ends and thereby provide a greater leakage potential between the seal segments within the apex seal slot. Furthermore, this angled mismatch is determined so that as the peripheral wall 12 changes to a concave shape as shown in phantom-line in FIG. 2 because of the gas pressure in the chambers and/or heat expansion, the gas pressure acting radially outwardly on the bottom side 66 of the end segments forces them to pivot slightly in opposite directions about their outer edges whereupn the central segment sides 80 then come into full contact with the end segment sides 72 and there is provided a tight seal all along their interfaces to further prevent internal leakage. In regard to minimizing bending stresses, it will also be appreciated that the two end segments 60 only need to conform to their half of the changing peripheral wall contour and thus experience much lower bending stress while providing easier conformability than a full length apex seal. As best shown in FIG. 3, a small chamfer Ω is provided at the lower outer edge of each of the end segments 60 to prevent this edge from rubbing on the side walls because of the radially inner portion of the end segments expanding lengthwise with heat more than the outer region which has the sealing surfaces 64 recognizing that the heat is being carried away through the latter to the rotor housing.

It will also be appreciated that the apex seal arrangement 46 according to the present invention can be used with peripheral porting, for example a peripheral exhaust port, in addition to side porting without the possibility of any of the parts protruding into such port. This is possible with the use of a bridge in the inner peripheral wall across the center of the exhaust port 42 as disclosed in copending U.S. Ser. No. 519,813, filed Nov. 1, 1974 and assigned to the assignee of this invention. With this arrangement the inner ends 70 of the end segment 60 and the top 67 of the central segment 62 are supported by the bridge as they pass over the exhaust port and still experience only low bending stress throughout their travel around the peripheral wall. It will also be appreciated that the bridge need not be centered and in that case one of the end segments would be made longer than the other to maintain the above relationship of the apex seal arrangement relative to the bridge across the port. It will also be appreciated that the intake port could be located in the peripheral wall and exhaust porting located in the side walls or both the intake and exhaust ports could be located in the peripheral wall. In either case, it is intended that with a peripheral port that the inner ends of the end segments and the top of the central segment are all located so that they are supported by the bridge across the port as they pass over.

The above described embodiment is illustrative of the invention which may be modified within the scope of the appended claims.

I claim:

1. An apex seal arrangement for a rotary combustion engine having an inner peripheral wall and oppositely facing side walls and a rotor between the side walls with apexes that remain adjacent the peripheral wall as the rotor rotates, said apex seal arrangement comprising a pair of end segments arrangeable in a slot in each rotor apex with oppositely facing inner ends that leave a space therebetween and flat outer ends that face the respective side walls, a central segment arrangeable in the slot in each rotor apex in said space between the inner ends of said end segments, spring means between the bottom of the slot and said central segment only to provide a radially outward force on said central segment, all of said segments having a sealing surface on a radially outward side for contacting the peripheral wall and said end segments also having a sealing surface on their outer end for contacting one of the side walls, said inner ends of said end segments having ramps inclined at opposite and equal oblique angles to the peripheral wall and side walls, the sealing surface of each said end segment extending approximately half the width of said peripheral wall whereby a small gap is left between the oppositely facing inner ends of said end segments at said peripheral wall, said central segment having a shape generally corresponding to said space with a bottom facing the bottom of the slot and oppositely inclined flat sides positively engaging the respective end segment ramps and a top with the sealing surface thereon fitting within said small gap and always located above the top of the apex seal slot so that when a radially outward force is applied to said central segment the sealing surface thereon is urged toward engagement with the peripheral wall while said central segment sides operate on said end segment ramps to urge said end segments into sealing surface engagement with both the peripheral wall and respective side walls whereby the only possible leakage gap is in said small gap left between the oppositely facing inner ends of said end segments and remains substantially filled by said central segment top above the top of the apex seal slot, and said inclined sides of said central segment having a substantially steeper angle than said ramps of said end segments so that their engagement initially occurs adjacent opposite sides of said small gap at the low end of the engine's heat and pressure ranges and then as the peripheral wall changes in cross-wise contour with gas pressure and/or heat expansion and the end segments tilt to conform thereto the ramps and inclined sides then proceed toward full engagement along their interfaces.

2. An apex seal arrangement for a rotary combustion engine having an inner peripheral wall and oppositely facing side walls and a rotor between the side walls with apexes that remain adjacent the peripheral wall as the rotor rotates, said apex seal arrangement comprising a pair of end segments arrangeable in a slot in each rotor apex with oppositely facing inner ends that leave a space therebetween and flat outer ends that face the respective side walls, a central segment arrangeable in the slot in each rotor apex in said space between the inner ends of said end segments, spring means between the bottom of the slot and said central segment only to provide a radially outward force on said central segment, all of said segments having a sealing surface on a radially outward side for contacting the peripheral wall and said end segments also having a sealing surface on their outer end for contacting one of the side walls, said inner ends of said end segments having ramps extending out past the top of the apex seal slot inclined at opposite and equal oblique angles to the peripheral wall and side walls, the sealing surface of each said end segment extending approximately half the width of said peripheral wall whereby a small gap is left between the oppositely facing inner ends of said end segments at said peripheral wall, said central segment having a shape generally corresponding to said space with a bottom facing the bottom of the slot and oppositely inclined flat sides positively engaging the respective end segment ramps and a top with the sealing surface thereon that fits within said small gap and remains located above the top of the apex seal slot with maximum heat expansion of all the seal segments so that when a radially outward force is applied to said central segment the sealing surface therein is urged toward engagement with the peripheral wall while said central segment sides operate on said end segment ramps to urge said end segments into sealing surface engagement with both the peripheral wall and respective side walls whereby the only possible leakage gap is in said small gap left between the oppositely facing inner ends of said end segments and remains substantially filled by said central segment top always above the top of the apex seal slot with maximum heat expansion of all the seal segments, and said inclined sides of said central segment having a substantially steeper angle than said ramps of said end segments so that their engagement initially occurs adjacent opposite sides of said small gap at the low end of the engine's heat and pressure ranges and then as the peripheral wall changes in cross-wise contour with gas pressure and/or heat expansion and the end segments tilt to conform thereto the ramps and inclined sides then proceed toward full engagement along their interfaces.

3. An apex seal arrangement for a rotary combustion engine having an inner peripheral wall and oppositely facing side walls and a rotor between the side walls with apexes that remain adjacent the peripheral wall as the rotor rotates, said apex seal arrangement comprising a pair of end segments arrangeable in a slot in each rotor apex with oppositely facing inner ends and flat outer ends that face the respective side walls, a central segment arrangeable in the slot in each rotor apex between the inner ends of said end segments, spring means between the bottom of the slot and said central segment only to provide a radially outward force on said central segment, all of said segments having a sealing surface on a radially outward side for contacting the peripheral wall and said end segments also having a sealing surface on their outer end for contacting one of the side walls, said inner ends of said end segments having ramps extending out past the top of the apex seal slot inclined at opposite and equal oblique angles to the peripheral wall and side walls leaving a trapezoidally shaped space therebetween occupied by said central segment, the sealing surface of each said end segment extending approximately half the width of said peripheral wall whereby a small gap is left between the oppositely facing inner ends of said end segments at said peripheral wall, said central segment having a trapezoidal shape sized to substantially fill said space with a long bottom facing the bottom of the slot and inclined flat sides positively engaging the respective end segment ramps and a short top having the central segment sealing surface thereon extending out past the top of the apex slot and fitting within said small gap so that when a radially outward force is applied to said central segment the sealing surface thereon is urged toward engagement with the peripheral wall while said sides operate on said end segment ramps to urge said end segments into sealing surface contact with both the peripheral wall and respective side walls whereby the only possible leakage gap is in said small small gap left between the oppositely facing inner ends of said end segments and is substantially filled by said central segment top beyond the top of the apex seal slot, said central segment being determined according to the heat expansion of all the seal segments so that the sealing surface thereon contacts or comes close to the peripheral wall when the engine is cold and does not recede therefrom as far as the top of the apex seal slot when the engine is hot whereby the gap remains substantially filled by the central segment top with heat expansion, and said inclined sides of said central segment having a substantially steeper angle than said ramps of said end segments so that their engagement initially occurs adjacent opposite sides of said small gap at the low end of the engine's heat and pressure ranges and then as the peripheral wall changes in cross-wire contour with gas pressure and/or heat expansion and the end segments tilt to conform thereto the ramps and inclined sides then proceed toward full engagement along their interfaces.

4. An apex seal arrangement for a rotary combustion engine having an inner peripheral wall and oppositely facing side walls and a rotor between the side walls with apexes that remain adjacent the peripheral wall as the rotor rotates, said apex seal arrangement comprising a pair of end segments arrangeable in a slot in each rotor apex with oppositely facing inner ends and flat outer ends that face the respective side walls, a central segment arrangeable in the slot in each rotor apex between the inner ends of said end segments, spring means between the bottom of the slot and said central segment only to provide a radially outward force on said central segment, all of said segments having a sealing surface on a radially outward side for contacting the peripheral wall and said end segments also having a sealing surface on their outer end for contacting one of the side walls, said inner ends of said end segments having oppositely facing flat radial portions above the top of the apex seal slot and ramps extending down into the apex seal slot inclined at opposite and equal oblique angles to the peripheral wall and side walls leaving a trapezoidally shaped space therebetween occupied by said central segment, the sealing surface of each said end segment extending approximately half the width of said peripheral wall whereby a small gap is left between the oppositely facing flat radial portions of said inner ends of said end segments, said central segment having a trapezoidal shape sized to substantially fill said space with a long bottom facing the bottom of the slot and oppositely inclined flat sides positively engaging the respective end segment ramps and a short top having the central segment sealing surface thereon extending out past the top of the apex seal slot and into said small gap between said flat radial portions so that when a radially outward force is applied to said central segment the sealing surface thereon is urged toward engagement with the peripheral wall while said sides operate on said end segment ramps to urge said end segments into sealing surface contact with both the peripheral wall and respective side walls whereby the only possible leakage gap is in said small gap left between the oppositely facing inner ends of said end segments and is substantially filled by said central segment top, said central segment being determined according to the heat expansion of all the seal segments so that the sealing surface thereon contacts or comes close to the peripheral wall when the engine is cold and does not recede therefrom as far as the top of the apex seal slot on thermal expansion of said segments when the engine is hot whereby the gap remains substantially filled by the central segment top with heat expansion, and said inclined sides of said central segment having a substantially steeper angle than said ramps of said end segments so that their engagement initially occurs adjacent opposite sides of said small gap at the low end of the engine's heat and pressure ranges and then as the peripheral wall changes in Cross-wise contour with gas pressure and/or heat expansion and the end segments tilt to conform thereto the ramps and inclined sides then proceed toward full engagment along their interfaces.

* * * * *